United States Patent [19]

McGuinness et al.

[11] Patent Number: 4,869,741

[45] Date of Patent: Sep. 26, 1989

[54] ULTRA PURE LIQUID OXYGEN CYCLE

[75] Inventors: Roger M. McGuinness, Fogelsville; Nellie Cilen, New Tripoli, both of Pa.

[73] Assignee: Air Products and Chemicals, Inc., Allentown, Pa.

[21] Appl. No.: 193,975

[22] Filed: May 13, 1988

[51] Int. Cl.[4] ..... F25J 3/02

[52] U.S. Cl. ..... 62/24; 62/40

[58] Field of Search ..... 62/23, 24, 40

[56] References Cited

U.S. PATENT DOCUMENTS

| | | | |
|---|---|---|---|
| 3,363,427 | 1/1968 | Blanchard et al. | 62/21 |
| 3,592,015 | 7/1971 | Streich et al. | 62/24 |
| 4,560,397 | 12/1985 | Cheung | 62/28 |
| 4,615,716 | 10/1986 | Cormier et al. | 62/24 |
| 4,702,757 | 10/1987 | Kleinberg | 62/24 |
| 4,704,147 | 11/1987 | Kleinberg | 62/24 |
| 4,704,148 | 11/1987 | Kleinberg | 62/24 |
| 4,762,542 | 8/1988 | Mishkovsky et al. | 62/40 |

*Primary Examiner*—Ronald C. Capossela

*Attorney, Agent, or Firm*—Willard Jones, II; James C. Simmons; William F. Marsh

[57] ABSTRACT

The present invention is a process for the production of 99.999+% pure oxygen. The process comprises a cryogenic distillation system which removes impurities from oxygen. The process can be operated independently of an air separation unit by using an external source to provide reboil and condensing duties for the distillation column.

8 Claims, 3 Drawing Sheets

ULTRA PURE LIQUID OXYGEN CYCLE

TECHNICAL FIELD

The present invention relates to a process for the purification of liquid oxygen by cryogenic distillation to produce an ultra high purity oxygen product.

BACKGROUND OF THE INVENTION

There are several processes known in the art for the production of ultra high purity oxygen; among these are U.S. Pat. Nos. 3,363,427; 4,560,397 and 4,615,716.

U.S. Pat. No. 3,363,427 discloses a process and an apparatus for the purification of a commercially pure oxygen feedstock by cryogenic distillation. The process basically liquefies the oxygen feedstock and rectifies the liquified oxygen in a single distillation column operating at a pressure slightly above atmospheric and a vapor-to-liquid ratio in excess of 0.700.

U.S. Pat. No. 4,560,397 is a process for the production of ultra high purity oxygen and elevated pressure nitrogen by cryogenic rectification of air wherein the product oxygen is recovered from a secondary column at a point above the liquid sump while impurities are removed from the column at a distance from the product withdrawal point.

U.S. Pat. No. 4,615,716 discloses a method of oxygen recycle on the bottom section of the low pressure column of a dual pressure column system. This along with an increase in the bottom section reboil vapor rate allows an appreciable increase in the production rate of ultra high purity oxygen and a substantial decrease in power required as compared to conventional processes.

SUMMARY OF THE INVENTION

The present invention is a process for the production of an ultra high purity liquid oxygen product from commercially pure liquid oxygen having residual low and high boiling impurities. In a first embodiment of the process, a commercially pure liquid oxygen stream is fed to a first column having an overhead condenser and bottoms reboiler. In the first column, residual high boiling impurities (e.g., hydrocarbons, krypton, xenon and carbon dioxide) and low boiling impurities (e.g., argon, nitrogen and carbon monoxide) are stripped or rectified and removed from the oxygen. A liquid side stream is removed from the first column at an intermediate location of the first column and fed to the top of a second column having a bottoms reboiler. This removed liquid stream is stripped in the second column thereby producing ultra high purity oxygen at the bottom of the second column, which is removed as ultra high purity oxygen product. Overhead from the second column is removed and returned to an intermediate location of the first column. At least a portion of the overhead from the first column is condensed in order to provide reflux to the first column.

In an alternate embodiment of the process, a commercially pure liquid oxygen stream is fed to a first distillation column having a bottoms reboiler to strip and remove residual high boiling impurities. Overhead from the first distillation column is removed and fed to an intermediate location of a second distillation column having an overhead condenser and a bottoms reboiler. The overhead stream is distilled in the second distillation column to separate and remove low boiling impurities thereby producing ultra high purity oxygen at the bottom of the second distillation column, which is removed from the second distillation column as ultra high purity oxygen product. An intermediate liquid side stream is removed from the second distillation column and returned to provide reflux to the top of the first distillation column. A portion of the overhead of the second distillation column is condensed in order to provide reflux to the second distillation column.

Reboiler and condenser heat duties for both embodiments of the process can be provided by external heat pump fluid sources, however, are preferably provided by a closed-loop nitrogen heat pump cycle. In this closed-loop nitrogen heat pump, a nitrogen stream is compressed, cooled and subsequently split into first and second nitrogen substreams. The first nitrogen substream is used to provide heat duty for the bottoms reboiler of the second column, likewise, the second nitrogen substream is used to provide heat duty for the bottoms reboiler of the first column. These first and second nitrogen substreams are flashed to provide refrigeration duty for the overhead condenser of the process. The condensed nitrogen is vaporized in the condenser. This vaporized nitrogen stream is further warmed to recover refrigeration and recycled to the compressor.

When the process is incorporated into a cryogenic air separation unit, a closed-loop nitrogen heat pump cycle may be unnecessary and can be replaced by an open-loop cycle. In the open-loop cycle, a first nitrogen stream from the air separation unit is used to provide heat duty for the bottoms reboiler of the second column, likewise, a second nitrogen stream from the air separation unit is used to provide heat duty for the bottoms reboiler of the first column. These first and second nitrogen streams are flashed to provide refrigeration duty for the overhead condenser of the process. The condensed nitrogen is vaporized in the condenser and returned to an appropriate location in the air separation unit. Nitrogen is the preferred heat pump fluid, however, any nitrogen containing stream from the air separation unit (e.g., air) can be used as the heat pump fluid. Also, when incorporated into a cryogenic air separation unit, the liquid oxygen feed to the first distillation column would be fed directly from an appropriate location in the air separation unit. Likewise, the bottoms liquid from the first distillation column and the overhead vapor not used as reflux could be returned to appropriate locations in the air separation unit.

DETAILED DESCRIPTION OF THE INVENTION

The industry is presented with the problem that there is no effective and efficient process to produce ultra high purity liquid oxygen (UHP LOX) for the electronics industry. In the past this problem was addressed by running existing air separation units inefficiently to produce a liquid oxygen stream containing very little argon, nitrogen and carbon monoxide. This liquid was then processed in a separate unit to remove krypton, xenon, carbon dioxide and hydrocarbons. This procedure is very expensive. Particular solutions to the problem have been discussed in the Background of the Invention Section of this application, however, these solutions typically are expensive to build and still have high operating costs.

The process of the present invention is an energy efficient and cost effective solution to the foregoing problem. The process is a cycle for the production of UHP LOX at 99.999+%. The design is independent of an air separation unit, in that the cycle can take conventional purity liquid oxygen from a storage tank and process it into UHP LOX. Notwithstanding the foregoing, the process can also be fully integrated into an air separation unit.

Figure 1:
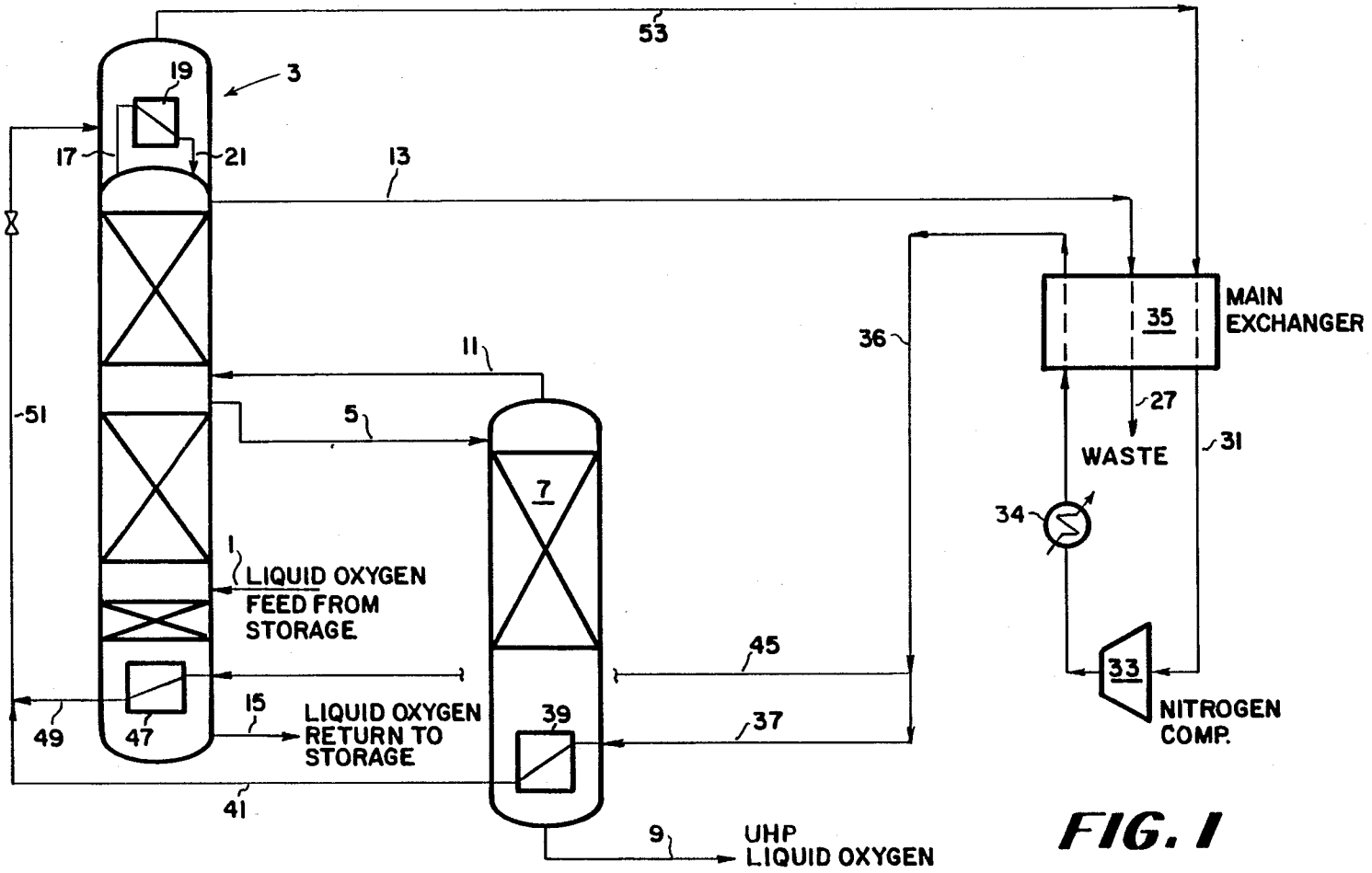
FIG. 1 is a schematic diagram of a first embodiment of the process of the present invention.

The process is best understood with reference to a specific embodiment thereof as depicted in FIG. 1. The flow scheme of FIG. 1 refers to the independent design.

With reference to FIG. 1, liquid oxygen from a storage tank is fed via line 1 to a lower location of distillation column 3. In distillation column 3, hydrocarbons, carbon dioxide, krypton and xenon, which may be present in the liquid oxygen feed, are separated from the liquid oxygen feed stream in the lower and middle sections of column 3 and are removed via line 15. The bottoms liquid which is removed via line 15 from column 3 can be returned to the liquid oxygen storage tanks. In the upper section of column 3, argon, nitrogen and carbon monoxide are separated and removed via line 13. This argon rich waste stream is warmed in heat exchanger 35 to recover refrigeration prior to being vented as waste via line 27. A portion of the overhead vapor from column 3 is removed via line 17 and condensed in condenser 19. The condensed overhead is returned to column 3 via line 21 to provide reflux to the column. In addition, a portion of the bottoms liquid of column 3 is vaporized in reboiler 47 to provide reboil for column 3. Finally, a liquid side stream is removed via line 5 from column 3 from a location between the middle and upper sections of column 3 and fed to the top of second column 7. Column 3 can operate over a wide range of pressures; typically, the column pressure is fixed by the required final storage pressure. The optimum operating pressure is in the 15 to 25 psia range. Above this range distillation becomes less efficient.

Second column 7 is used to purify the liquid oxygen from a purity of about 99.5% to a minimum purity of 99.999%. In the purification of the oxygen side stream, residual argon, nitrogen and carbon monoxide are separated from the oxygen side stream and returned with the column overhead. UHP LOX product is removed from the bottom of column 7 via line 9 and is sent to storage. A portion of the bottoms liquid of column 7 is vaporized in reboiler 39 to provide reboil for column 7. Second column 7 operates at the same pressure range as column 3. Overhead from column 7 is removed via line 11 and returned to column 3 at the same location in column 3 as the liquid side stream withdrawn in line 5.

Reflux and reboil duties for the process are provided by a closed-loop nitrogen heat pump cycle. In the cycle, nitrogen in line 31 is compressed in compressor 33 to a pressure in the range of 90 to 120 psia and then cooled in aftercooler 34 and heat exchanger 35 prior to being split into two substreams. First substream 37 is fed to reboiler 39 to provide reboil duty to column 7; it is removed from reboiler 39 via line 41. Second substream 45 is fed to reboiler 47 to provide reboil duty to column 3; it is removed from reboiler 47 via line 49. The cooled first and second substreams in lines 41 and 49 are combined to form condenser duty stream 51, which is reduced in pressure to the 60 to 80 psia level and fed to the sump surrounding condenser 19 where it boils and provides refrigeration to condense overhead stream 17. The vapor from the overhead of the sump surrounding condenser 19 is removed via line 53 and warmed in heat exchanger 35 to recover refrigeration. This warmed nitrogen stream is then recirculated via line 31.

When the process is integrated within an air separation unit, the nitrogen recycle loop can be replaced with an open-loop heat pump cycle. In an air separation unit incorporation, the process would look similar to FIG. 1 with the exception that compressor 33, aftercooler 34 and heat exchanger 35 would not be present. Additionally, although it may be preferable to have nitrogen as the heat pump fluid, any nitrogen containing stream would also work (e.g., air). Also, when incorporated into a cryogenic air separation unit, liquid oxygen feed 1 to first distillation column 3 would be fed directly from an appropriate location in the air separation unit. Likewise, the bottoms liquid 15 from the first distillation column and the overhead argon rich waste stream 27 would be returned to appropriate locations in the air separation unit.

Figure 2:
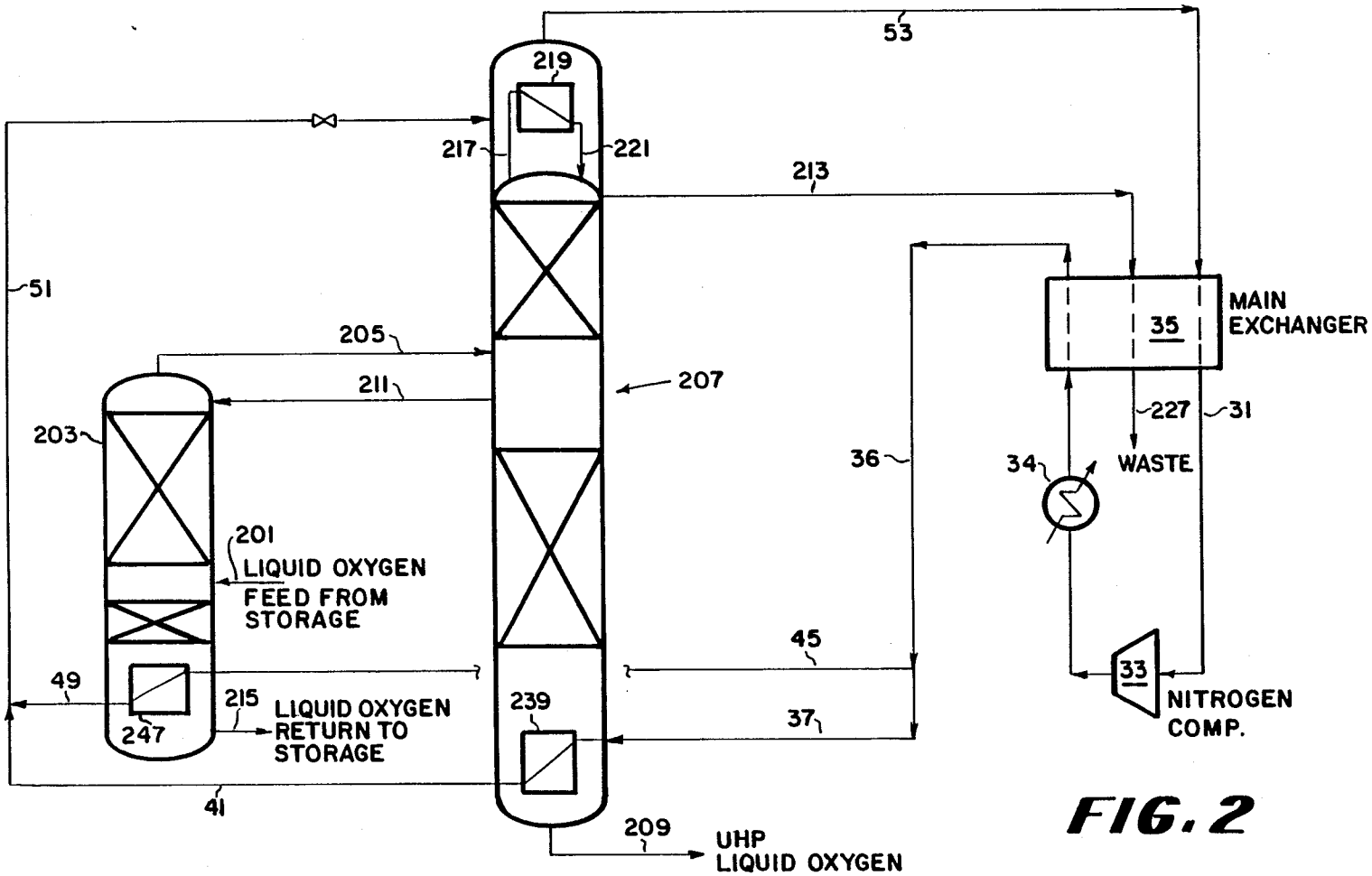
FIG. 2 is a schematic diagram of a second embodiment of the process of the present invention.

An alternate embodiment of the present invention is depicted in FIG. 2. The process depicted in FIG. 2 is similar to that in FIG. 1, except that the rectifying section of the process has been combined in a single distillation column with the stripping section in which the UHP LOX product is produced. With reference to FIG. 2, liquid oxygen from a storage tank is fed via line 201 to a lower location of distillation column 203. In distillation column 203, high boiling impurities, which may be present in the liquid oxygen feed, are separated from the liquid oxygen feed stream in column 203 and are removed via line 215. A portion of the bottoms liquid from column 203 is vaporized in reboiler 247 to provide reboil to column 203. The bottoms liquid which is removed via line 215 from column 203 can be returned to the liquid oxygen storage tanks. The overhead from column 203 is removed and fed via line 205 to an intermediate location of second distillation column 207. Second column 207 is used to purify the liquid oxygen from a purity of about 99.5% to a minimum purity of 99.999%. In second column 207, an overhead stream containing oxygen and low boiling impurities is separated and removed as a waste stream via line 213. This waste stream is warmed in heat exchanger 35 to recover refrigeration prior to being vented as waste via line 227. A portion of the overhead vapor from column 207 is removed via line 217 and condensed in condenser 219. The refrigeration for the condensation of the overhead vapor in line 217 is provided by the vaporization of the liquid nitrogen stream in line 51, which is fed to the sump surrounding condenser 219. The vaporized nitrogen is removed from condenser area 219 via line 53. The condensed overhead is returned to column 207 via line 221 to provide reflux to the column. A liquid side stream is removed via line 211 from column 207 and returned to the top of first column 203. UHP LOX product is removed from the bottom of column 207 via line 209 and is sent to storage. A portion of the bottoms liquid from column 207 is vaporized in reboiler 239 to provide reboil to column 207. Column 203 and 207 are operated at the same pressure and can operate over a wide range of pressures; typically, the column pressure is fixed by the required final storage pressure. The optimum operating pressure is in the 15 to 25 psia range. Above this range distillation becomes less efficient.

Like the first embodiment, reflux and condenser duties for the process are provided by a closed-loop nitrogen heat pump cycle. Also, when the process is integrated within an air separation unit, the closed-loop heat pump cycle can be replaced with an open-loop heat pump cycle. Also, when incorporated into a cryogenic air separation unit, liquid oxygen feed 201 to first distillation column 203 would be fed directly from an appropriate location in the air separation unit. Likewise, the bottoms liquid 215 from the first distillation column and the overhead waste stream 227 would be returned to appropriate location in the air separation unit.

The above described invention provides a process to produce UHP LOX efficiently and cost effectively. Also, the independent nature of the process allows a small skid mounted system to be produced which can be completely independent of an air separation unit.

In order to demonstrate the efficacy of the present invention and to provide a basis for comparison between the present invention and the closest prior art, the following two examples were computer simulated.

EXAMPLES

EXAMPLE I

The process of the present invention as depicted in FIG. 1 was computer simulated. Material balance information for selected streams is shown in Table I. In addition, information on the energy required for the process has been provided in Table III.

TABLE I

MATERIAL BALANCE AND STREAM DATA FOR SELECTED STREAMS
PROCESS AS DEPICTED IN FIG. 1

| Stream Number | Temperature °F. | Pressure psia | Flow Rates: lb-mol/hr Total | Ar | $O_2$ | $CH_4$ |
|---|---|---|---|---|---|---|
| 1 | −287.2 | 25.0 | 45.0 | 0.16 | 44.835 | 0.005 |
| 5 | −288.5 | 23.2 | 143.2 | 0.4 | 142.8 | 0.0 |
| 9 | −284.9 | 28.0 | 28.6 | 0.0 | 28.6 | 0.0 |
| 11 | −286.6 | 25.7 | 114.6 | 0.4 | 114.2 | 0.0 |
| 13 | −290.2 | 22.5 | 1.0 | 0.15 | 0.85 | 0.0 |
| 15 | −287.3 | 24.8 | 15.4 | 0.01 | 15.385 | 0.005 |

EXAMPLE II

Figure 3:
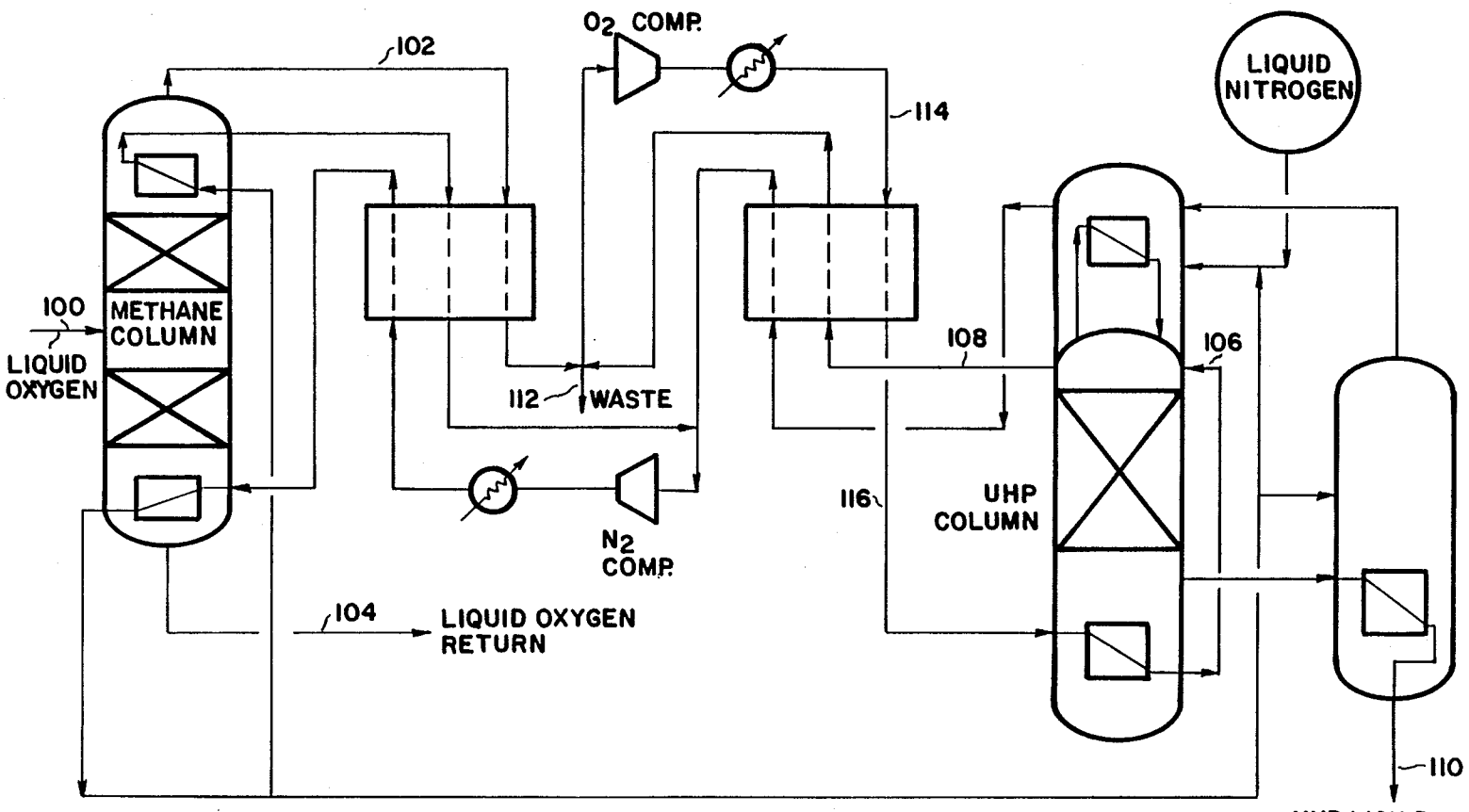
FIG. 3 PRIOR ART
FIG. 3 is a schematic diagram of the process according to U.S. Pat. No. 3,363,427 adapted to utilize a liquid oxygen feedstock.

For this example, the process of U.S. Pat. No. 3,363,427 has been simplified to provide for the use of liquid oxygen instead of gaseous oxygen as the feedstock. The simplified process is depicted in FIG. 3. Liquid oxygen enters the middle of the first distillation column. High boiling impurities are stripped from the feed and withdrawn from the bottom of the column. Oxygen, containing less than 1 ppm methane, is removed overhead and warmed to ambient temperature before combining with recycle and compression to approximately 30 psia. The gas is then cooled again to near its dew point by circulating nitrogen and used for feed to the second column. Prior to its introduction into the column, the gas is condensed, its latent heat being used to reboil the second column. The liquid is then flashed to about 17 psia and enters the second column. Ultra-high purity oxygen is removed as vapor from the bottom of the column and can be condensed against liquid nitrogen in another vessel. Oxygen recycle is removed from the top of the column, warmed and combined with distillate from the first column. Liquid nitrogen is used in the condenser of the second column.

Material balance information for selected streams of the process are shown in Table II. Process energy information has also been provided in Table III.

TABLE II

MATERIAL BALANCE AND STREAM DATA FOR SELECTED STREAMS
PROCESS AS DEPICTED IN FIG. 3

| Stream Number | Temperature °F. | Pressure psia | Flow Rates: lb-mol/hr Total | Ar | $O_2$ | $CH_4$ |
|---|---|---|---|---|---|---|
| 100 | −297.0 | 15.0 | 35.8 | 0.125 | 35.671 | 0.004 |
| 102 | −297.3 | 14.4 | 32.2 | 0.125 | 32.075 | 0.0 |
| 104 | −296.9 | 14.7 | 3.58 | 0.0 | 3.576 | 0.004 |
| 106 | −295.0 | 17.0 | 104.0 | 2.25 | 101.75 | 0.0 |
| 108 | −294.5 | 17.0 | 75.4 | 2.25 | 73.15 | 0.0 |
| 110 | −293.4 | 17.9 | 28.6 | 0.0 | 28.6 | 0.0 |
| 112 | 80.0 | 30.0 | 3.58 | 0.125 | 3.455 | 0.0 |
| 114 | 80.0 | 30.0 | 32.2 | 0.125 | 32.075 | 0.0 |
| 116 | −283.5 | 30.0 | 32.2 | 0.125 | 32.075 | 0.0 |

It can be seen from a comparison of FIGS. 1 and 3 that the process of the present invention is significantly simpler than that for U.S. Pat. No. 3,363,427. The present invention eliminates the need for one set of heat exchangers and an oxygen compressor.

Another benefit that can be seen for the present invention is that, based upon simulations for the same total tray count, the process of the present invention has a 98% oxygen recovery vs. a 90% recovery for U.S. Pat. No. 3,363,427. This increased recovery is due to a more optimal distillation arrangement, with the rectifying column section minimizing waste flows.

Still another benefit of the present invention is the energy efficiency of the process of the present invention. A comparison of the energy requirements for the two examples are shown in Table III.

TABLE III

COMPARISON OF POWER CONSUMPTIONS

Process of the Present Invention $N_2$ Compressor

Flow = 287 lbmol/hr
$P_{in}$ = 59 psia
$P_{out}$ = 100 psia
Isothermal efficiency = 65%
Motor efficiency = 95%
Power = 74 kw Total Power Power = 74 kw U.S. Pat. No. 3,363,427 Process $N_2$ Compressor Flow = 100 lbmol/h
$P_{in}$ = 59 psia
$P_{out}$ = 100 psia
Isothermal efficiency = 62%**
Motor efficiency = 95%
Power = 27 kw $O_2$ Compressor Flow = 220 lbmol/h
$P_{in}$ = 14.4 psia
$P_{out}$ = 30 psia
Isothermal efficiency = 55%***
Motor efficency = 95%
Power = 92 kw Total Power Power = 119 kw Notes:
**Smaller compressors are slightly less efficient
***Oxygen compressors are less efficient than nitrogen compressors As can be seen from the above comparison, the process of the present invention is 37.8% more energy efficient, i.e., 74 kw vs. 119 kw.

Finally, in comparison with the practice of running conventional plants very inefficiently, the new cycle is considerably more economical and efficient.

The process of the present invention has been described with reference to specific embodiments thereof. These embodiments should not be seen as a limitation on the scope of the present invention. The scope of such should be ascertained by the following claims.

We claim:

1. A process for the production of an ultra high purity liquid oxygen product from commercially pure liquid oxygen having residual low and high boiling impurities which comprises:

a. feeding a commercially pure liquid oxygen stream to a first distillation column having an overhead condenser and bottoms reboiler to rectify and remove low boiling impurities and strip and remove high boiling impurites;

b. removing a liquid side stream from the first distillation column at an intermediate location of the first distillation column and feeding the removed liquid stream to a second distillation column having a bottoms reboiler;

c. stripping the removed liquid stream in the second distillation column thereby producing ultra high purity oxygen at the bottom of the second distillation column;

d. removing the ultra high purity oxygen from the bottom of the second distillation column as ultra high purity oxygen product;

e. removing the overhead from the second distillation column and returning the overhead from the second distillation column to an intermediate location of the first distillation column;

f. condensing at least a portion of the overhead from the first distillation column in order to provide reflux to the first distillation column; and g. providing heat duties for the reboiler and condenser of the first distillation column and the reboiler of the second distillation column with external heat pump fluid sources.

2. The process of claim 1, wherein heat duty for the reboiler and condenser of the first distillation column and the reboiler of the second distillation column is provided by a closed-loop nitrogen heat pump cycle, which comprises compressing and cooling a nitrogen stream; splitting the compressed, cooled nitrogen stream into first and second nitrogen substreams; utilizing the first nitrogen substream to provide heat duty for the bottoms reboiler of the second distillation column; utilizing the second nitrogen substream to provide heat duty for the bottoms reboiler of the first distillation column; flashing the cooled nitrogen streams to provide refrigeration duty for the overhead condenser of the first distillation column wherein the condensed nitrogen is vaporized; warming the vaporized nitrogen stream to recover refrigeration; and recycling the warmed nitrogen stream for compression.

3. A process for the production of an ultra high purity liquid oxygen product from liquid oxygen having residual low and high boiling impurities from a cryogenic distillation air separation unit which comprises:

a. feeding a liquid oxygen stream to a first distillation column having an overhead condenser and bottoms reboiler to rectify and remove low boiling impurities and strip and remove high boiling impurities;

b. removing a liquid side stream from the first distillation column at an intermediate location of the first distillation column and feeding the removed liquid stream to a second distillation column having a bottoms reboiler;

c. stripping the removed liquid stream in the second distillation column thereby producing an ultra high purity oxygen at the bottom of the second distillation column;

d. removing the ultra high purity oxygen from the bottom of the second distillation column as ultra high purity oxygen product;

e. removing the overhead from the second distillation column and returning the overhead from the second distillation column to an intermediate location of the first distillation column;

f. condensing at least a portion of the overhead from the first distillation column in order to provide reflux to the first distillation column; and g. providing heat duties for the reboiler and condenser of the first distillation column and the reboiler of the second distillation column with external heat pump fluid sources.

4. The process of claim 3, wherein heat duty for the reboiler and condenser of the first distillation column and the reboiler of the second distillation column is provided by an open-loop nitrogen heat pump cycle, which comprises utilizing a first nitrogen substream to provide heat duty for the bottoms reboiler of the second distillation column; utilizing a second nitrogen substream to provide heat duty for the bottoms reboiler of the first distillation column; flashing the cooled nitrogen streams to provide refrigeration duty for the overhead condenser of the first distillation column wherein the condensed nitrogen is vaporized; warming the vaporized nitrogen stream to recover refrigeration; and recycling the warmed nitrogen stream for compression.

5. A process for the production of an ultra high purity liquid oxygen product from commercially pure liquid oxygen having residual low and high boiling impurities which comprises:

a. feeding a commercially pure liquid oxygen stream to a first distillation column having a bottoms reboiler to rectify and remove residual high boiling impurities;

b. removing overhead from the first distillation column and feeding the first distillation column overhead to an intermediate location of a second distillation column having an overhead condenser and a bottoms reboiler;

c. distilling the first distillation column overhead in the second distillation column to separate and remove low boiling impurities thereby producing an ultra high purity oxygen at the bottom of the second distillation column;

d. removing the ultra high purity oxygen from the bottom of the second distillation column as ultra high purity oxygen product;

e. removing an intermediate liquid side stream from the second distillation column and returning the intermediate liquid side stream from the second distillation column to the top of the first distillation column;

f. condensing at least a portion of the overhead from the second distillation column in order to provide reflux to the second distillation column; and g. providing heat duties for the reboiler of the first distillation column and the condenser and reboiler of the second distillation column with external heat pump fluid sources.

6. The process of claim 5, wherein heat duty for the reboiler of the first distillation column and the condenser and reboiler of the second distillation column is provided by a closed-loop nitrogen heat pump cycle, which comprises compressing and cooling a nitrogen stream; splitting the compressed, cooled nitrogen stream into first and second nitrogen substreams; utilizing the first nitrogen substream to provide heat duty for the bottoms reboiler of the second distillation column; utilizing the second nitrogen substream to provide heat duty for the bottoms reboiler of the first distillation column; flashing the cooled nitrogen streams to provide refrigeration duty for the overhead condenser of the second distillation column wherein the condensed nitrogen is vaporized; warming the vaporized nitrogen stream to recover refrigeration; and recycling the warmed nitrogen stream for compression.

7. A process for the production of an ultra high purity liquid oxygen product from liquid oxygen having residual low and high boiling impurities from a cryogenic distillation air separation unit which comprises:

a. feeding a liquid oxygen stream to a first distillation column having a bottoms reboiler to rectify and remove residual high boiling impurities;

b. removing overhead from the first distillation column and feeding the first distillation column overhead to an intermediate location of a second distillation column having an overhead condenser and a bottoms reboiler;

c. rectifying the first distillation column overhead in the second distillation column to separate and remove low boiling impurities thereby producing an ultra high purity oxygen at the bottom of the second distillation column;

d. removing the ultra high purity oxygen from the bottom of the second distillation column as ultra high purity oxygen product;

e. removing an intermediate liquid side stream from the second distillation column and returning the intermediate liquid side stream from the second distillation column to the top of the first distillation column;

f. condensing at least a portion of the overhead from the second distillation column in order to provide reflux to the second distillation column; and g. providing heat duties for the reboiler of the first distillation column and the condenser and reboiler of the second distillation column with external heat pump fluid sources.

8. The process of claim 7, wherein heat duty for the reboiler of the first distillation column and the condenser and reboiler of the second distillation column is provided by an open-loop nitrogen heat pump cycle, which comprises utilizing a first nitrogen substream to provide heat duty for the bottoms reboiler of the second distillation column; utilizing a second nitrogen substream to provide heat duty for the bottoms reboiler of the first distillation column; flashing the cooled nitrogen streams to provide refrigeration duty for the overhead condenser of the first distillation column wherein the condensed nitrogen is vaporized; warming the vaporized nitrogen stream to recover refrigeration; and recycling the warmed nitrogen stream for compression.

* * * * *